US005520452A

United States Patent [19]

Petersen et al.

[11] Patent Number: 5,520,452

[45] Date of Patent: May 28, 1996

[54] FILE CABINET DRAWER SLIDE DISCONNECT

[75] Inventors: Kirk Petersen; Chris Zorich, both of Muscatine; Dale Higdon, Davenport, all of Iowa

[73] Assignee: Hon Industries Inc., Muscatine, Iowa

[21] Appl. No.: 286,924

[22] Filed: Aug. 8, 1994

[51] Int. Cl.[6] ..... A47B 88/00

[52] U.S. Cl. ..... 312/334.12; 312/334.13; 312/334.15; 312/334.18; 312/330.1

[58] Field of Search ..... 312/334.12, 334.13, 312/334.15, 334.18, 330.1

[56] References Cited

U.S. PATENT DOCUMENTS

| | | | |
|---|---|---|---|
| 1,068,375 | 7/1913 | Watson et al. | 312/334.12 |
| 1,227,939 | 5/1917 | Sampson et al. | 312/334.13 X |
| 1,518,687 | 12/1924 | Bullock | 312/334.13 |
| 1,692,805 | 11/1928 | Anderson | 312/334.13 |
| 1,725,338 | 8/1929 | Card et al. | 312/334.12 |
| 2,031,251 | 2/1936 | Clark | 312/334.13 |
| 2,630,364 | 3/1953 | Gleason | 312/334.12 X |
| 2,704,699 | 3/1955 | Evans . | |
| 2,843,444 | 7/1958 | Nelson . | |
| 2,869,961 | 1/1959 | Gomersall | 312/334.12 |
| 3,123,419 | 3/1964 | Maxwell | 312/334.13 X |
| 3,278,250 | 10/1966 | Vogt | 312/334.12 |
| 3,328,106 | 6/1967 | Mullin . | |
| 3,418,026 | 12/1968 | Ericson . | |
| 3,433,548 | 3/1969 | Moore . | |
| 3,701,577 | 10/1972 | Fischer . | |
| 3,746,418 | 7/1973 | Barber, Jr. . | |
| 3,782,800 | 1/1974 | Remington et al. . | |
| 4,441,772 | 4/1984 | Fielding et al. . | |
| 4,453,790 | 6/1984 | Cohen et al. . | |
| 4,473,262 | 9/1984 | Staye . | |
| 4,749,242 | 6/1988 | Rechberg . | |
| 4,962,974 | 10/1990 | Fitz . | |
| 4,983,000 | 1/1991 | Röck . | |
| 5,002,402 | 3/1991 | Parvin . | |
| 5,033,805 | 7/1991 | Hobbs . | |
| 5,211,462 | 5/1993 | Tuefel et al. . | |
| 5,281,021 | 1/1994 | Röck . | |

FOREIGN PATENT DOCUMENTS

| | | | |
|---|---|---|---|
| 108033 | 7/1939 | Australia | 312/334.13 |
| 112492 | 2/1941 | Australia | 312/334.13 |
| 1119229 | 3/1982 | Canada | 312/334.13 |
| 585271 | 2/1947 | United Kingdom | 312/334.12 |

*Primary Examiner*—Peter M. Cuomo
*Assistant Examiner*—Rodney B. White
*Attorney, Agent, or Firm*—Jones, Day, Reavis & Pogue

[57] ABSTRACT

A file cabinet drawer slide assembly comprises a slide arm which is fitted with rotatable rollers, the rollers being dimensioned and configured to support a hem of a cabinet drawer. The slide arm is cooperable with a generally C-shaped track fixed to an inside side wall of the cabinet and configured to receive and support the slide arm in rolling telescoping relationship. A pivotable cam member is secured to the forward end of the slide arm in proximity to one of the rollers defining a slot through which the hem of the drawer travels. The bottom wall of the drawer is provided with a downward projection which engages a cross brace connected to the slide arm and normally prevents removal of the drawer. When the cam member is pivoted away from the hem, the drawer may be lifted sufficiently such that the projection disengages from the cross brace and the drawer can be removed from the cabinet.

8 Claims, 5 Drawing Sheets

FILE CABINET DRAWER SLIDE DISCONNECT

BACKGROUND OF THE INVENTION

1. Field of the Invention

The present invention relates generally to roller slides for supporting drawers in a cabinet, and it relates more particularly to a drawer outstop feature which prevents accidental removal of the drawer while allowing the drawer to be easily removed when desired.

2. Description of the Prior Art

In the construction of cabinets, particularly file cabinets, a wide variety of mechanisms are known for enabling drawers to freely slide in and out of the cabinet enclosure. Typically, these mechanisms include pairs of drawer slides comprising interfitting C-shaped rails fitted with suitable rollers. The slides thereby permit the drawer to roll out of the cabinet with little friction.

One type of drawer slide mechanism includes a carriage. The drawer is supported on rollers in the carriage which, in turn, is supported by tracks mounted to the cabinet. As the drawer is pulled out, the carriage moves outwardly also, permitting the drawer to be supported in a fully open condition. The latter assembly has gained wide acceptance particularly in lateral file cabinets because it permits file folders within the drawer to be fully accessible when the drawer is opened.

It is imperative in the construction of file cabinets that the drawer slide is provided with an outstop feature which normally prevents removal of the drawer in the fully opened condition. This feature prevents the drawer from accidentally dissociating from the cabinet causing possible injury to the user. However, it is also desirable to provide a latching mechanism which permits the drawer to be removed under circumstances in which the user chooses to remove it, such as when the cabinet itself is being mowed and the drawers are empty. To this end, a variety of latching mechanisms are known such as disclosed in Fielding et al., U.S. Pat. No. 4, 441, 772 and Rechberg, U.S. Pat. No. 4, 749, 242. Typically, these latching mechanisms include a manually pivotable latch arm which is mounted to one of the drawer slides and selectively cooperates with an associated slide member to prevent longitudinal separation of the slides except when the latch arm is manually pivoted.

While the foregoing latching mechanisms are effective in preventing a drawer from being accidentally removed, these mechanisms are often complex in construction and expensive to manufacture. Further, the complexity of these mechanisms frequently causes difficulty to the user in attempting to discover without instructions how the mechanism is operated. It is, therefore, desirable to provide a drawer disconnect feature which positively prevents accidental removal of the drawer yet easily permits the drawer to be removed at the preference of the user.

SUMMARY OF THE INVENTION

The present invention provides a cabinet drawer slide assembly comprising a slide arm which is fitted with rotatable rollers, the rollers being dimensioned and configured to support a hem of a cabinet drawer. The slide arm is cooperable with a generally C-shaped track fixed to an inside side wall of the cabinet and configured to receive and support the slide arm in rolling telescoping relationship. A pivotable cam member is secured to the forward end of the slide arm in proximity to one of the rollers defining a slot through which the hem of the drawer travels. The bottom wall of the drawer is provided with a downward projection which engages a cross brace connected to the slide arm and normally prevents removal of the drawer. When the cam member is pivoted away from the hem, the drawer may be lifted sufficiently such that the projection disengages from the cross brace and the drawer can be removed from the cabinet.

BRIEF DESCRIPTION OF THE DRAWINGS

The features and advantages of the invention will become apparent from the following detailed description taken in connection with the accompanying drawings wherein.

DESCRIPTION OF THE PREFERRED EMBODIMENTS

Figure 1:
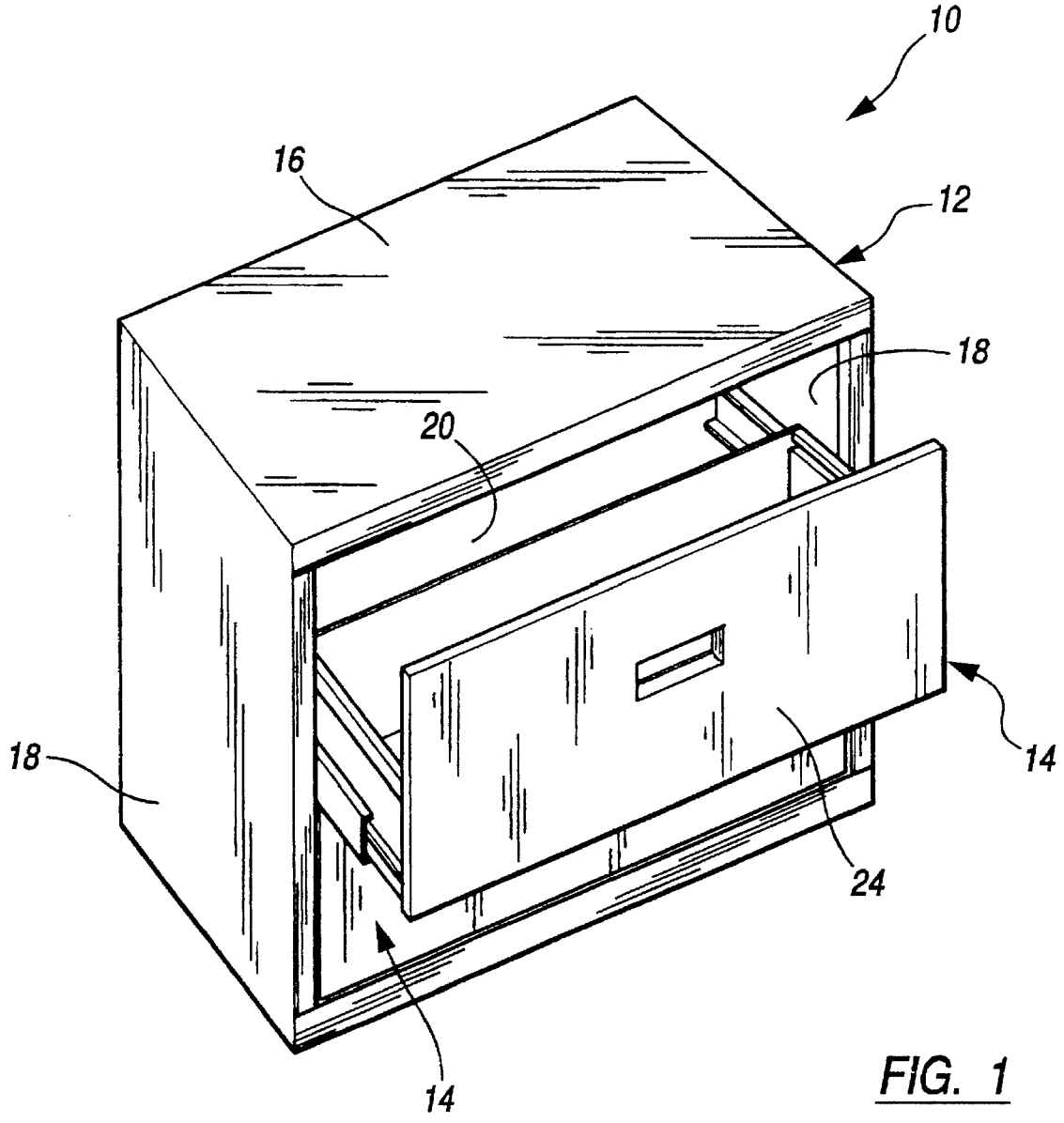
FIG. 1. is a perspective view of a lateral file cabinet constructed in accordance with the invention.
Figure 2:
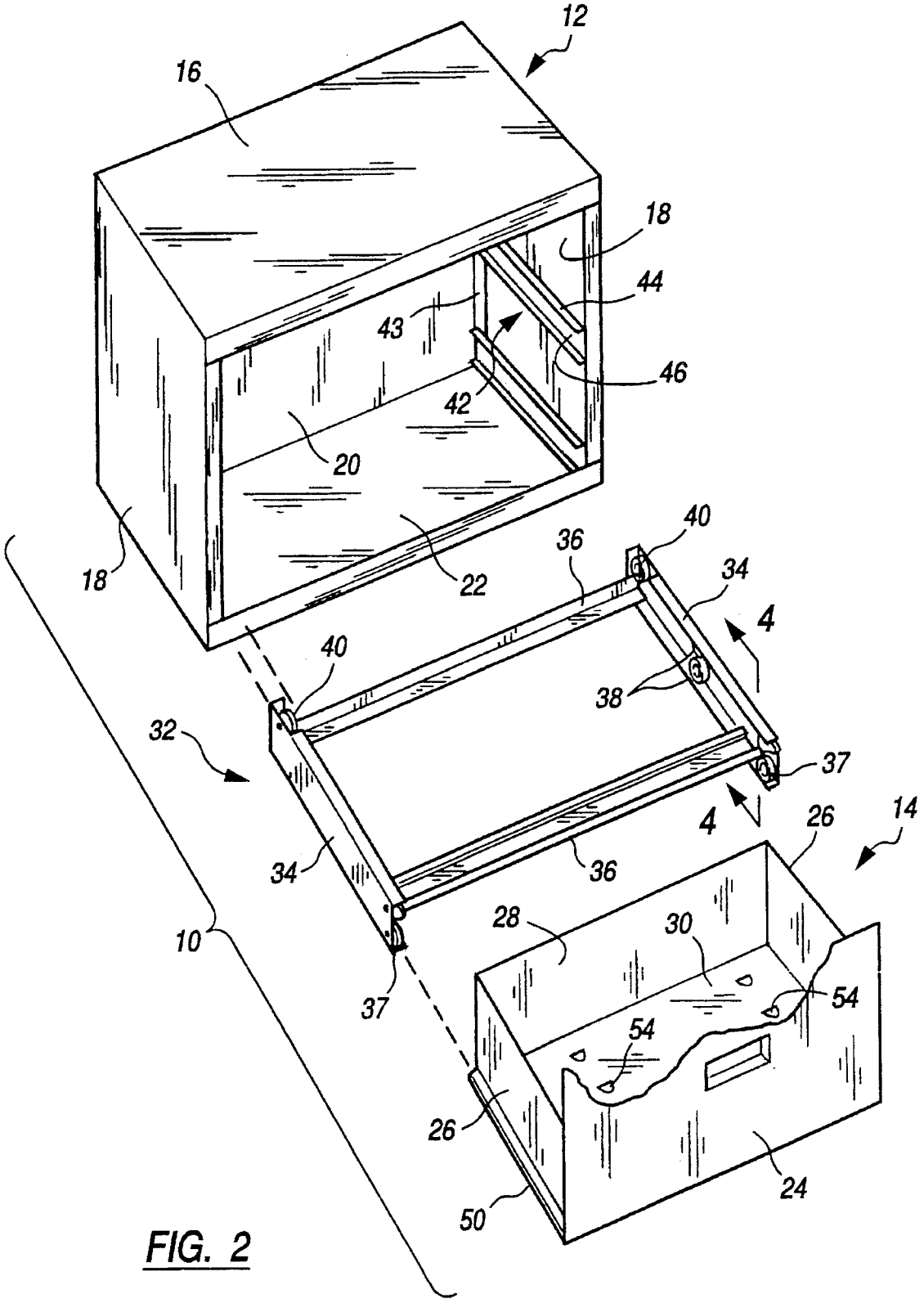
FIG. 2. is an exploded perspective view of the file cabinet shown in FIG. 1.

Turning now to the drawings, and initially to FIGS. 1 and 2, a cabinet assembly is designated generally by the reference numeral 10 and includes a case, or cabinet 12 which houses a pair of drawers 14. It is noted that the illustrated assembly 10 is a file cabinet of the lateral file cabinet type. However, it will be appreciated that the invention is equally adaptable to vertical filing cabinets as well as numerous other cabinets not intended for filing of paper matter or the like. In the illustrated embodiment, the cabinet assembly 10 is preferably constructed of formed sheet steel having a top wall 16, two side walls 18, a rear wall 20 and a front and rear bottom channel (not shown).

Figure 3:
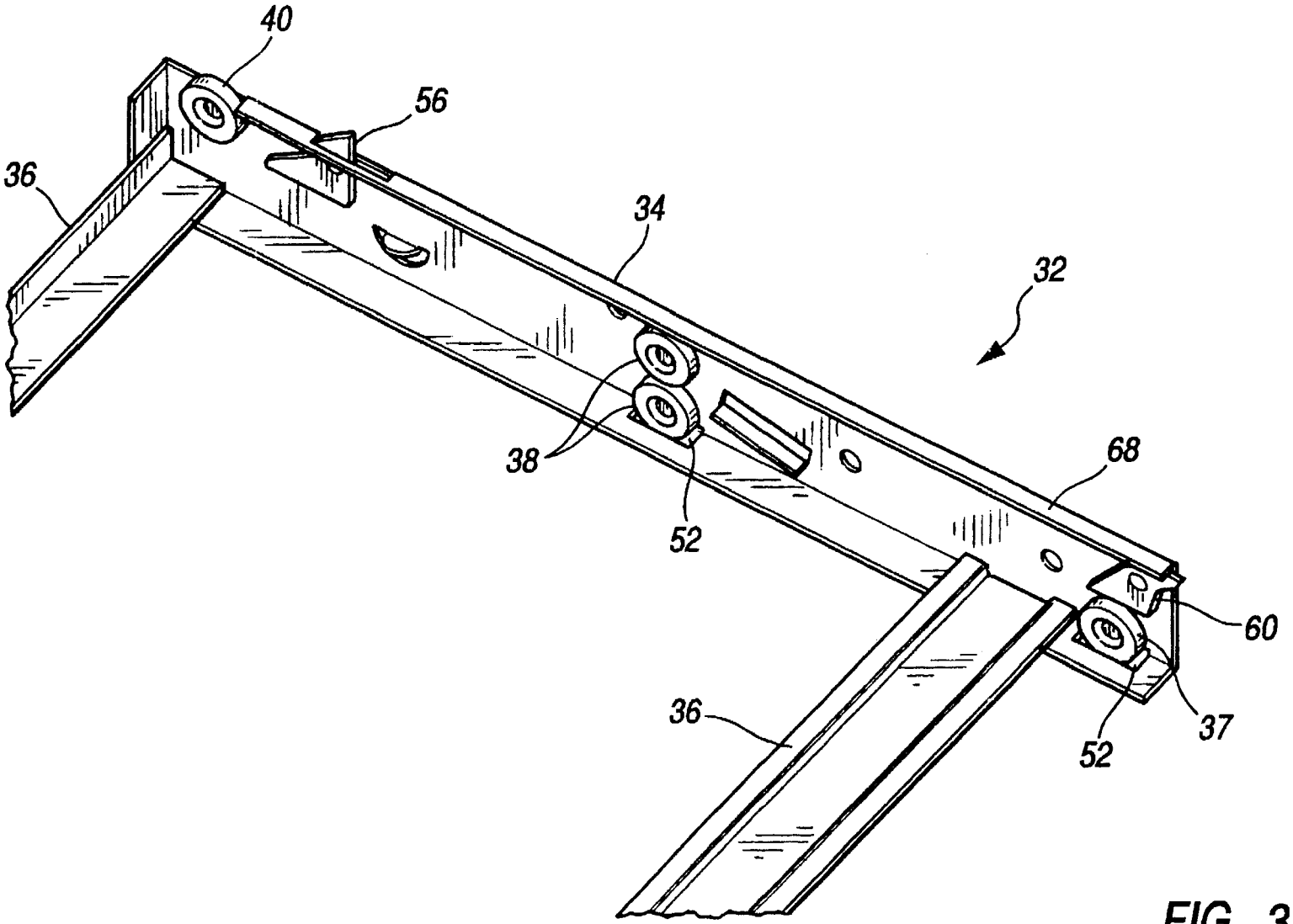
FIG. 3. is a fractional perspective view of carriage assembly in accordance with the invention.

Each drawer 14 has a front 24, a pair of sides 26, a back 28 and a bottom 30, all constructed from fabricated sheet steel. In accordance with the invention, and as best seen in FIGS. 2 and 3, the cabinet assembly includes a carriage assembly 32 comprising a pair of slide arms 34 connected by a pair of cross braces 36. The slide arms 34 are generally C-shaped in cross-section and are each fitted with a forward roller 37, a pair of opposed, spaced intermediate rollers 38 and a rear roller 40. The rollers may be formed from a suitable plastic and attached by rivets to the slide arms 34.

As best seen in FIG. 2, the slide arms 34, are each telescopingly received by tracks 42 mounted to the inside side walls 18 of the cabinet 12 and spaced inwardly of the side walls 18 by suitable rails 43. The tracks 42 are generally C-shaped and comprise a pair of flanges 44 joined by a central web 46. The flanges 44 serve to provide bearing surfaces on which the rollers 37, 38 and 40 can roll.

Figure 4:
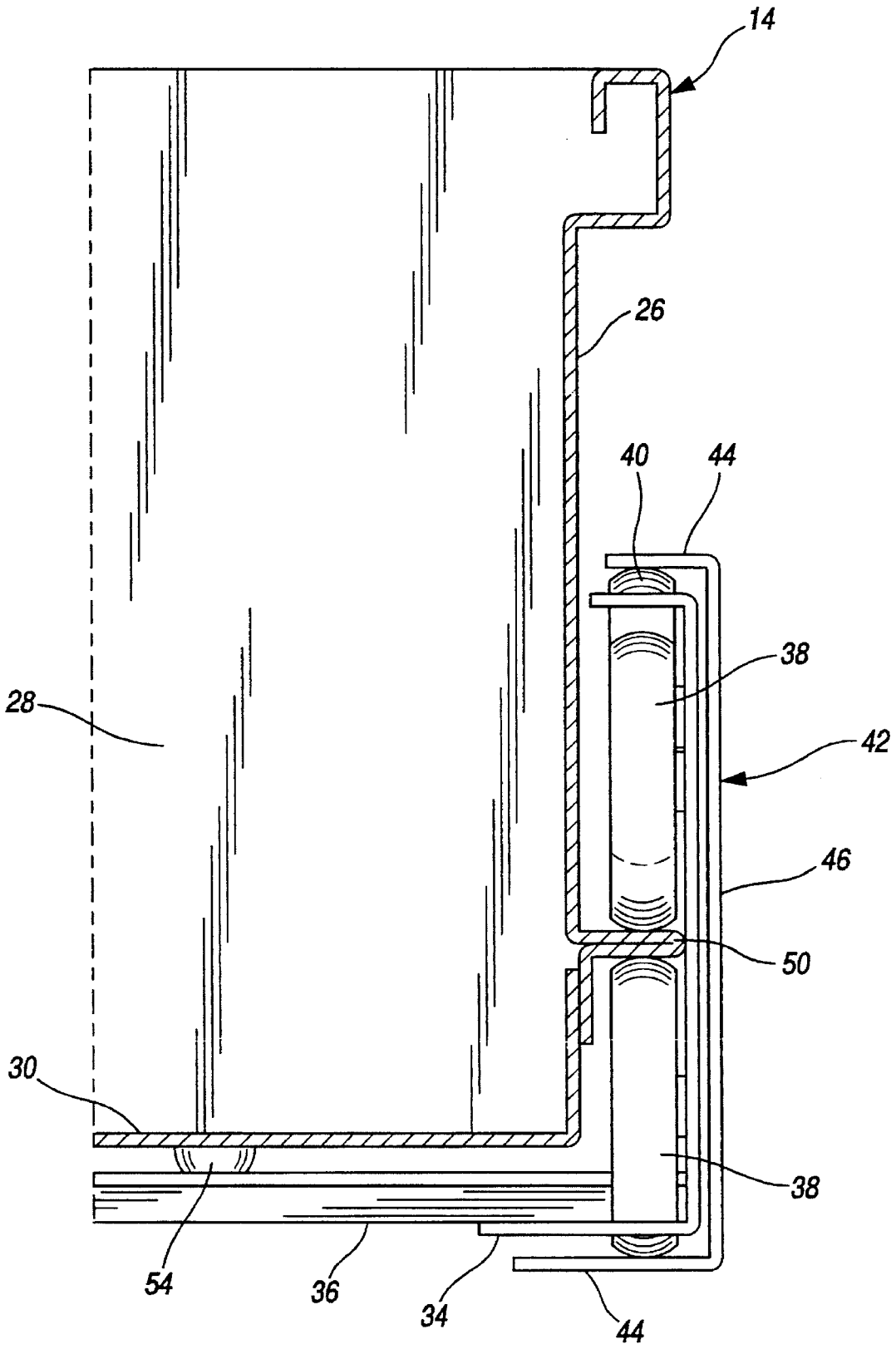
FIG. 4. is a cross-sectional view of the drawer slide arm and track assembly taken substantially along the line 4—4 of FIG. 2 with the drawer shown as being in supported position.

Turning now to FIG. 4, the operation of the drawer 14, slide arms 34 and tracks 42 can be seen in cross-section. The side 26 of the drawer 14 is constructed with a hem 50 forming a laterally projecting flange running the length of the drawer 14. It will be appreciated that only one side 26 of the drawer 14 is illustrated in FIG. 4. However, the other side 26 is the mirror image thereof. It can be seen in FIG. 4 that the intermediate rollers 38 are spaced from one another sufficiently to define a slot through which the hem 50 travels as the drawer 14 is moved in and out of the cabinet 12. Also openings 52 are formed in the slide arms 34 through which the forward roller 37 and lowermost intermediate roller 38 project slightly such that the rollers 37 and 38 ride on the lowermost flanges 44 of the tracks 42. By this configuration, the hem 50 of the drawer side 26 is fully supported against downward loads by the forward roller 37 and intermediate rollers 38. Likewise the carriage assembly 32 is fully supported by the cooperation of the slide arm rollers 38 and 40 with the flanges 44 of the tracks 42.

In order to prevent removal of the drawer 14 from the cabinet 12, as best seen in FIGS. 2 and 4, the bottom 30 of the drawer is provided with downwardly extending projections 54. These projections 54 may simply be struck into the bottom 30 piece of the drawer 14. In operation the projections 54 engage the forward cross brace 36 of the carriage assembly 32 when the drawer 14 is pulled out, thereby providing a positive drawer outstop feature for the drawers 14. To prevent the carriage assembly 32 from accidental removal, an outstop pawl 56 is pivotably fixed to the slide arm 34 and configured such that by gravity a corner of the pawl 56 projects through a slot 58 formed in the slide arm 34. A suitably positioned slot (not shown) may be formed in the upper flange 44 of the track 42 such that when the carriage assembly 32 moves outwardly to a preselected position, the pawl 56 will pivot by gravity and engage the slot in the flange 44 thereby preventing the carriage 32 from further outward movement.

Figure 5:
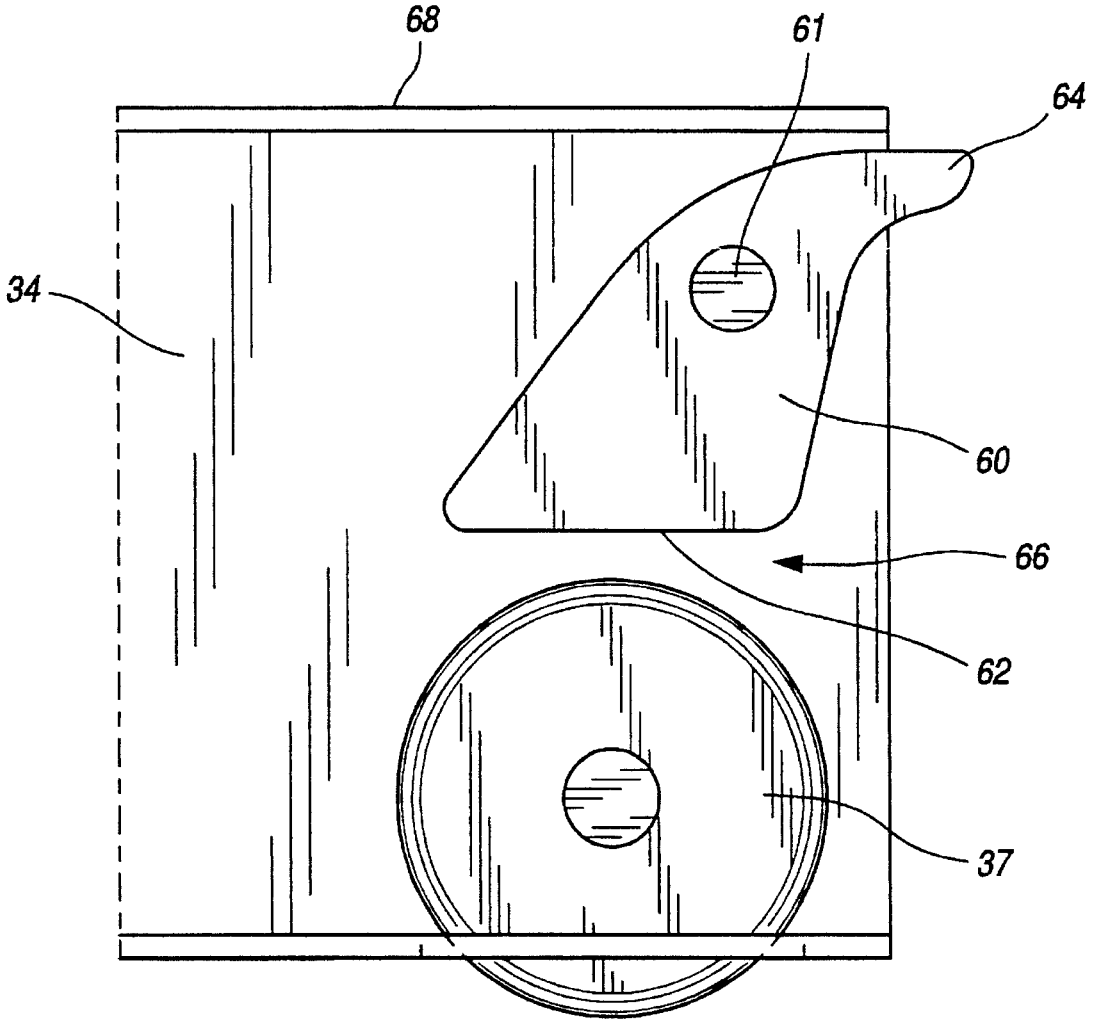
FIG. 5. is a fractional side elevation view of the forward end of a slide arm of the invention.

An important feature of the invention is the drawer disconnect feature provided by a cam member 60 which is pivotably secured by a rivet 61 to the forward end of the slide arm 34 in closely spaced relation to the forward roller 37, as best seen in FIGS. 3 and 5. The cam member 60 includes a flat portion 62 and a lever portion 64. When the cam member 60 is in its normal position under the force of gravity, the flat portion 62 is approximately horizontal and faces the forward roller 37 defining a slot 66 through which the hem 50 travels. This alignment of the cam member 60 is provided by the abutment of the lever portion 64 with upper flange 68 of the slide arm 34 under action of gravity. In this alignment of the cam member 60, the hem 50 of the drawer 14 is essentially trapped against upward movement. Accordingly, the drawer 14 may not be lifted such that the hem 50 moves appreciably off the forward roller 37. Correspondingly, when the hem 50 is trapped by the cam member 60, outward movement of the drawer 14 will cause the projections 54 of the drawer bottom 30 to positively engage the forward cross brace 36 of the carriage assembly 32, thereby preventing removal of the drawer 14 from the carriage slide arms 34.

It can now be appreciated that cam member 60 serves as a convenient means for disconnecting the drawer 14 from the cabinet 12. When desired, the lever portion 64 of the cam member 60 may simply be pushed downwardly with the fingertip causing the flat portion 62 to pivot upwardly away from the roller 37, or clockwise as viewed in FIG. 5. This action opens the slot 66 and permits the drawer 14 to be lifted such that the hem 50 is lifted off the roller 36. Correspondingly, when the drawer 14 is lifted, the projections 54 on the bottom of the drawer 14 sufficiently clear the cross brace 36 such that the drawer 14 may be disconnected from the carriage assembly and completely withdrawn from the cabinet 12. Because the cam member 60 is readily visible when the drawer 14 is pulled out, even the inexperienced user can easily discern how to disconnect the drawer 14 by pivoting the cam member 60. Moreover, this disconnect feature is simple in construction and readily manufacturable.

While the present invention has been described in connection with particular embodiments thereof, it will be understood by those skilled in the art that many changes may be made without departing from the true spirit and scope of the present invention.

What is claimed:

1. A cabinet drawer slide assembly comprising:

a generally C-shaped slide arm having an upper flange and fitted with rotatable rollers, said rollers being dimensioned and configured to support a hem of a cabinet drawer;

a generally C-shaped track attachable to an inside wall of a cabinet and configured to receive and support said slide arm in telescoping relationship;

a pivotable cam member secured to said slide arm in proximity to one of said rollers defining a slot through which said hem travels, said cam member being provided with a lever portion extending outwardly of a forward end of said slide arm to permit manual pivoting of said cam member, said cam member further being configured to be normally positioned under the effect of gravity with said lever portion in abutment with said flange when said slot is defined, wherein pivoting of said cam member allows said hem to be manually lifted off of said one of said rollers.

2. The assembly of claim 1 wherein said cam member is provided with a flat portion to thereby define said slot.

3. The assembly of claim 1 further comprising a carriage formed from a pair of slide arms connected by a pair of cross braces.

4. The assembly of claim 3 further including a drawer and wherein said drawer is formed with a bottom wall having at least one downward projection struck therein, said projection engaging a forward one of said cross braces to prevent removal of said drawer from said cabinet.

5. The assembly of claim 4 wherein lifting of said hem off of said roller permits said projection to disengage from said cross brace.

6. The assembly of claim 4 wherein said bottom wall is provided with multiple downward projections.

7. The assembly of claim 1 wherein said one of said rollers is mounted to the forward end of said slide arm.

8. A cabinet drawer and slide assembly comprising:

a carriage formed from a pair of slide arms and at least one connecting cross brace, each slide arm having an upper flange and being fitted with a plurality of rollers, said rollers being dimensioned and configured to support a laterally extending hem formed in the side of a cabinet drawer to permit said hem to freely roll thereon;

a pair of generally C-shaped tracks attachable to inside side walls of a cabinet, each track configured to receive and support a slide arm in rolling telescoping relationship;

a cam member pivotably secured to one of said slide arms at a forward end thereof in proximity with one of said rollers to define a slot through which said hem travels, said cam member having a lever portion extending outwardly of said forward end of said slide arm to permit manual pivoting of said cam member, said cam member further being configured to be normally positioned under the effect of gravity with said lever portion in abutment with said flange when said slot is defined, and a bottom wall of said drawer having a downward projection formed therein which engages said cross brace of said carriage to prevent removal of said drawer from said cabinet;

wherein pivoting of said cam member allows said hem to be lifted off said one of said rollers permitting said projection to disengage said cross brace for removal of said drawer from said cabinet.

* * * * *